US006871749B2

(12) United States Patent
Bostick et al.

(10) Patent No.: US 6,871,749 B2
(45) Date of Patent: Mar. 29, 2005

(54) EXTENDABLE/RETRACTABLE VALET RACK

(75) Inventors: Jimmy R. Bostick, Plano, TX (US); Michael W. Freitas, Colleyville, TX (US)

(73) Assignee: Dillingham Products Company, LLC, Dallas, TX (US)

( * ) Notice: Subject to any disclaimer, the term of this patent is extended or adjusted under 35 U.S.C. 154(b) by 0 days.

(21) Appl. No.: 10/412,542

(22) Filed: Apr. 11, 2003

(65) Prior Publication Data

US 2004/0200791 A1 Oct. 14, 2004

(51) Int. Cl.[7] ..... A47F 5/08
(52) U.S. Cl. ..... 211/94.01
(58) Field of Search ..... 211/94.01, 85.3, 211/162

(56) References Cited

U.S. PATENT DOCUMENTS

| | | | | | |
|---|---|---|---|---|---|
| 2,985,311 | A | | 5/1961 | Abel | 211/86 |
| 3,335,872 | A | | 8/1967 | Dodich | 211/86 |
| 3,762,570 | A | | 10/1973 | Tobin | 211/13 |
| 3,897,122 | A | * | 7/1975 | McEvers | 312/321 |
| 3,938,667 | A | | 2/1976 | Buckland | 211/87 |
| 3,954,182 | A | * | 5/1976 | McEvers | 211/94.01 |
| 4,427,119 | A | | 1/1984 | Savino | 211/94 |
| D273,645 | S | | 5/1984 | McEvers | D6/117 |
| D277,248 | S | | 1/1985 | Benedict | D6/324 |
| D277,436 | S | | 2/1985 | Benedict | D6/315 |
| D280,575 | S | | 9/1985 | Benedict | D6/324 |
| 4,569,450 | A | | 2/1986 | Dillingham | 211/96 |
| 4,585,127 | A | * | 4/1986 | Benedict | 211/34 |
| 4,611,721 | A | | 9/1986 | Heckaman | 211/100 |
| 4,771,897 | A | | 9/1988 | Ho | 211/13 |
| 4,771,899 | A | * | 9/1988 | Benedict et al. | 211/60.1 |
| 4,863,043 | A | | 9/1989 | Bowen | 211/113 |
| 5,148,925 | A | | 9/1992 | Althoff et al. | 211/41 |
| D334,291 | S | | 3/1993 | Rooke | D6/317 |
| 5,191,984 | A | | 3/1993 | Kon et al. | 211/115 |
| 5,425,463 | A | | 6/1995 | Toscanini et al. | 211/96 |
| 5,590,940 | A | | 1/1997 | Richard | 312/287 |
| 5,740,927 | A | | 4/1998 | Yemini | 211/70.6 |
| D409,847 | S | | 5/1999 | Augspurger | D6/324 |
| 6,021,907 | A | | 2/2000 | O'Brien | 211/89.01 |
| 6,152,312 | A | | 11/2000 | Nava et al. | 211/94.01 |
| 6,196,396 | B1 | | 3/2001 | Bennett | 211/85.3 |
| 6,484,893 | B1 | * | 11/2002 | Tkatch | 211/94.02 |

* cited by examiner

*Primary Examiner*—Hugh B. Thompson II
*Assistant Examiner*—Sarah Purol
(74) *Attorney, Agent, or Firm*—Dennis T. Griggs

(57) ABSTRACT

A valet rack assembly includes a three-piece fully extendable slide assembly having a base rail for installation on a closet sidewall in an operative position, an intermediate extension member slidably coupled to the base rail, an outer housing member slidably coupled to the intermediate member, and an apparel support member in the form of a tie clasp or belt post slidably coupled to the outer housing member. The intermediate extension member provides a first range of extension from a first position wherein the intermediate member is fully retracted and overlaps substantially all of the base rail, to a first stop position wherein the intermediate member only partially overlaps the base rail. The outer housing member provides a second range of extension from a second position wherein the outer member is fully retracted and overlaps substantially all of the intermediate extension member, to a second stop position wherein the outer member only partially overlaps the intermediate extension member.

26 Claims, 7 Drawing Sheets

92T
104
145
106
144
92
102

94
32
36
110
46A
46
46B
34
46C 28
44
48
126
24
128
128
124
98
100
92
120
108
94
96

EXTENDABLE/RETRACTABLE VALET RACK

TECHNICAL FIELD OF THE INVENTION

This invention relates generally to closet accessories, and in particular to an apparel support device in the nature of an extendable/retractable valet rack particularly adapted for organizing and storing clothing accessories such as neckties and belts, and as a valet rod from which an ensemble of clothing items may be hung on clothes hangers for easy access, or from which a travel bag may be suspended for providing convenient access to packed clothing items.

BACKGROUND OF THE INVENTION

The problem of organizing a wardrobe that may include shirts, pants, suits and various clothing accessories such as neckties and belts within a confined space, such as a closet or wardrobe, is well recognized. Apparel storage devices of various shapes and sizes have been previously developed in an attempt to use available closet and wardrobe space more efficiently by a systematic arrangement of apparel articles.

For example, an organized arrangement of apparel articles is shown in U.S. Pat. No. 3,897,122 that discloses a cabinet for neckwear having telescoping bars carried on built-in guides. In this particular design, support elements are attached to the telescoping bars to provide support for neckties. Another arrangement is shown in U.S. Pat. No. 6,152,312 wherein a suspension system for various types of hanging supports is provided. This solution includes a section bar that is positioned within a wardrobe closet for removably receiving hanging support devices, e.g., tie carrier hooks, skirt carriers/hangers and trousers carriers/hangers.

There is a continuing interest in providing apparel storage devices that make more efficient use of available closet and wardrobe space for storing and organizing clothing accessories such as neck ties and belts that can be extended and retracted for convenient to use, require only a minium amount of space for operation, do not interfere with the storage or retrieval of other clothing items, can be installed in existing closets and wardrobes, and present an aesthetically pleasing appearance.

BRIEF SUMMARY OF THE INVENTION

Accordingly, the present invention is directed to an extendable valet rack assembly that can be used for holding neck ties and belts, and that can also be used as a valet rod for holding hanger-supported items such as shirts, trousers, blouses, coats, jackets and skirts. In particular, by providing an effective and aesthetically pleasing three-piece fully extendable and retractable slide assembly, the valet rack assembly of the present invention provides a highly visible and systematic arrangement of clothing accessories such as neckties, belts, scarfs and the like. The extendable/retractable valet rack of the present invention makes efficient use of available closet and wardrobe space, and can be manufactured at a reasonable cost while maintaining an aesthetic appearance.

In one aspect, the present invention is directed to an extendable/retractable valet rack assembly including a base rail that can be mounted on the wall panel of an existing support structure such as a clothing closet, an intermediate housing member slidably coupled to the base rail, an outer housing member slidably coupled to the intermediate housing member, and one or more apparel support elements slidably coupled to the outer housing member. The intermediate housing member is extendable and retractable along the base rail through a first range of extension from a fully retracted position, wherein the intermediate housing member overlaps substantially all of the base rail, to a first extended position wherein the intermediate housing member partially overlaps the base rail and engages a first stop member. Over-extension of the intermediate housing member relative to the base member is prevented by first and second stop members that are brought into interfering contacting engagement against each other at the first stop position.

The outer housing member is extendable and retractable along the intermediate housing member through a second range of extension from a fully retracted position, wherein the outer housing member overlaps substantially the entire intermediate housing member, to a second extended position wherein the outer housing member partially overlaps the intermediate housing member and engages a second stop position. Over-extension of the outer housing member relative to the intermediate housing member is prevented by third and fourth stop members that are brought into interfering contacting engagement against each other at the second stop position.

In one embodiment, the outer housing member includes a longitudinal channel extending between its opposite ends. The longitudinal channel is defined in part by opposed sidewalls and elongated parallel opposed grooves formed in the sidewalls. Apparel support elements, for example tie clasps or belt posts, are slidably received in the channel and grooves.

In another aspect, the present invention is directed to a method for supporting one or more apparel support elements, for example, neck tie clasps or belt buckle posts, on an extendable/retractable valet rack assembly. The method includes slidably engaging one or more apparel support elements into a longitudinal channel formed on an outer housing of the assembly, sliding the apparel support elements to intermediate positions along the longitudinal channel, and closing the channel with first and second end caps attached to opposite end portions of the outer housing, thereby retaining the apparel support elements on the rack assembly.

In another aspect, the invention is directed to an extendable and retractable valet rack assembly that includes a necktie clasp adapted for mounting on the outer housing member in either an upright or an inverted orientation. The necktie clasp includes a base member slidably coupled to the housing member so that it can be positioned at intermediate locations along the length of the rack assembly. The necktie clasp also includes a support arm attached to and canted transversely to the base member, and two or more flexing clasp portions attached to the support arm. The flexing clasp portions are operable to grip and retain an apparel article, for example a neck tie, in upright and inverted orientations.

According to another aspect, the present invention is directed to an extendable/retractable valet rack assembly that includes a symmetrical belt buckle post adapted for mounting on the extendable/retractable outer housing member in either an upright or an inverted orientation. The belt buckle post includes a base member slidably coupled to the outer housing member so that it can be positioned at intermediate locations along the length of the assembly. A shank portion connects a symmetrical hook portion to the base member whereby the belt buckle post can be installed and used in both the upright and the inverted orientations.

BRIEF DESCRIPTION OF THE DRAWING

The accompanying drawing is incorporated into and forms a part of the specification to illustrate the preferred embodiments of the present invention. Various advantages and features of the invention will be understood from the following detailed description taken with reference to the attached drawing figures in which.

DETAILED DESCRIPTION OF THE INVENTION

Figure 1:
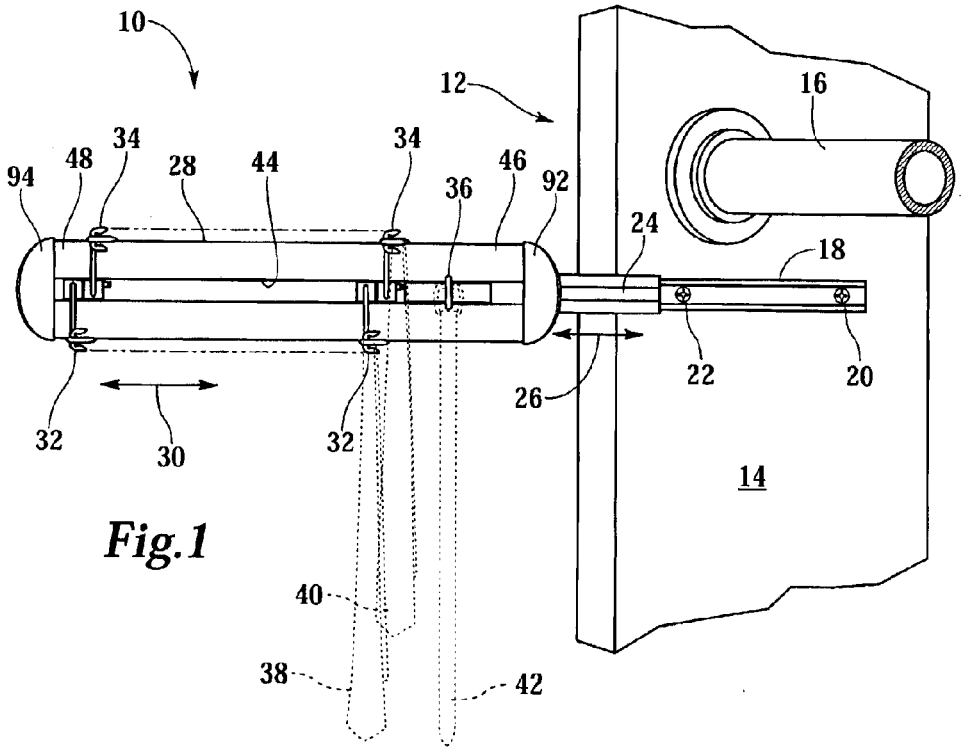
FIG. 1 is a perspective view of the valet rack assembly of the present invention installed a closet, shown in its fully extended position.

Preferred embodiments of the invention will now be described with reference to various examples of how the invention can best be made and used. Like reference numerals are used throughout the description and several views of the drawing to indicate like or corresponding parts.

Referring to FIG. 1, an extendable/retractable rack assembly 10 of the present invention is installed in a clothing closet 12. The closet 12 includes a side wall or partition panel 14 that provides support for a closet rod 16 that may be employed in combination with hangers to provide support to various apparel garments such as shirts, blouses, pants, coats, jackets and the like.

Figure 3:
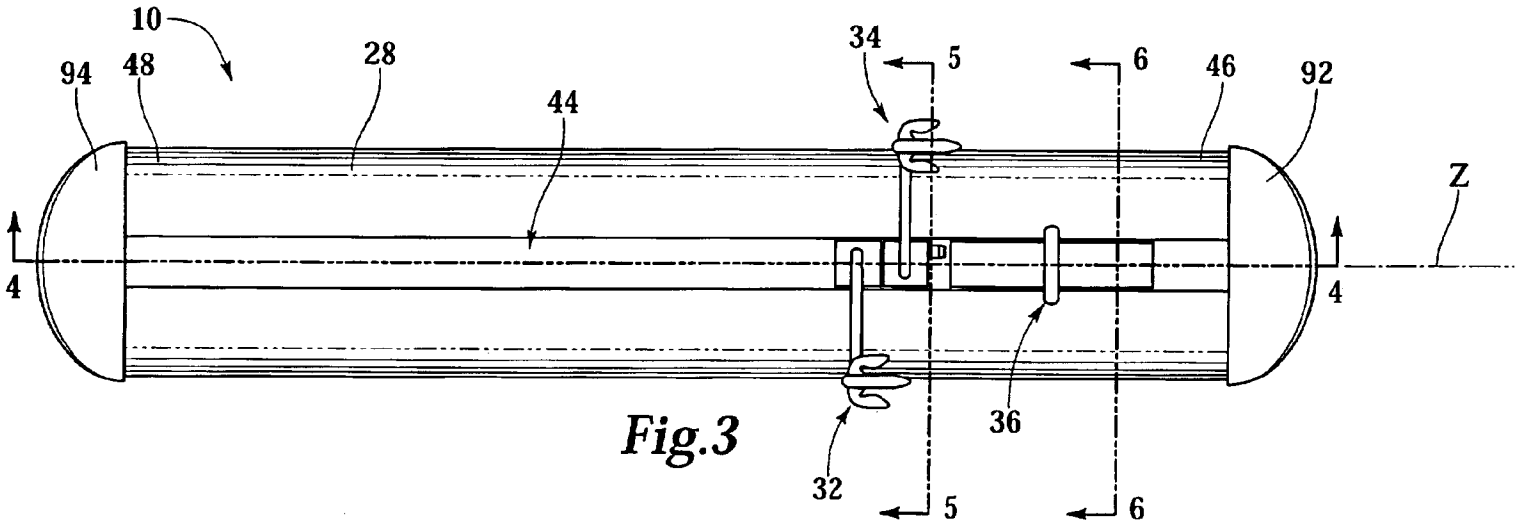
FIG. 3 is a top plan view of the valet rack assembly, shown in its fully retracted position.
Figure 4:
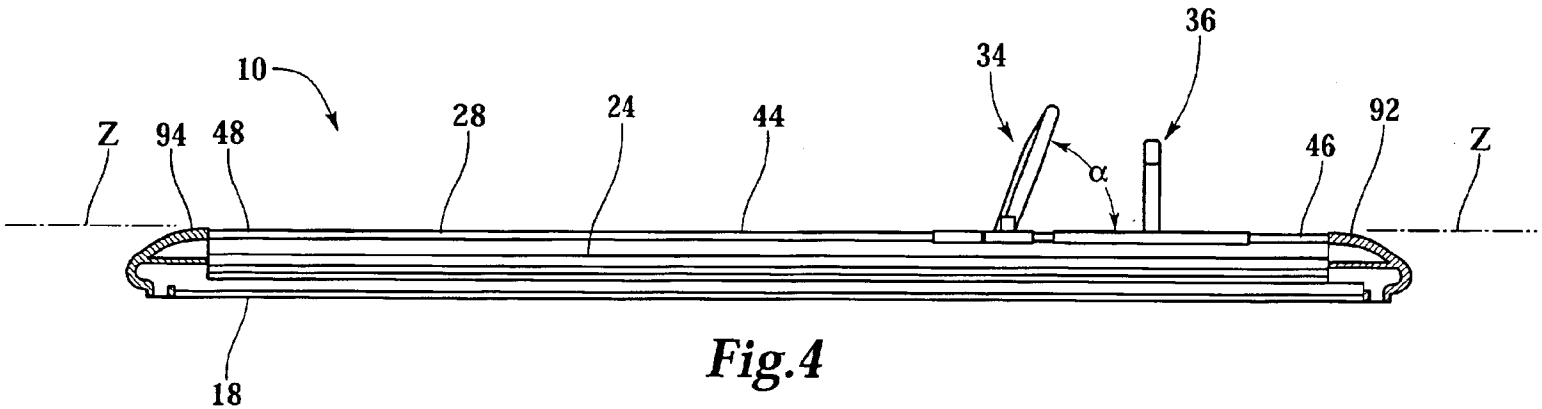
FIG. 4 is a cross-sectional view of the valet rack assembly taken along line 4—4 of FIG. 3.
Figure 13:
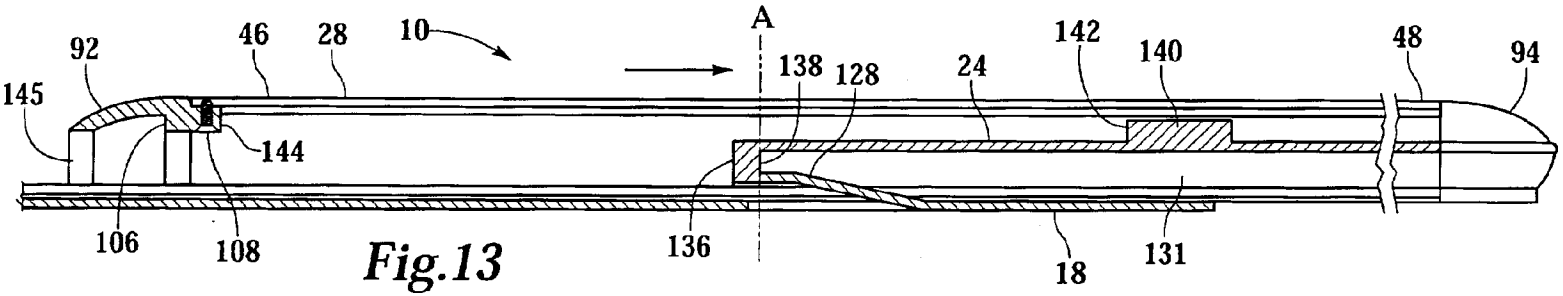
FIG. 13 is a cross-sectional view of the base rail and intermediate housing member engaged at a first extended stop position of the valet rack assembly.

The extendable/retractable valet rack assembly 10 of the present invention is configured in a three-piece fully extendable slide arrangement including a base rail 18 that is mounted to the side wall 14 by wood screws 20, 22, but nails, bolts, dowels, pins and other fasteners could be used. An intermediate housing member 24 is slidably coupled to the base rail 18 and provides a first range of extension, as indicated by the arrow 26, for extension from a fully retracted position wherein the intermediate housing member 24 overlaps substantially all of the base rail 18, as shown in FIG. 3 and FIG. 4, to a first extended stop position where the intermediate housing member 24 only partially overlaps the base member 18, as shown in FIG. 1 and FIG. 13.

Figure 14:
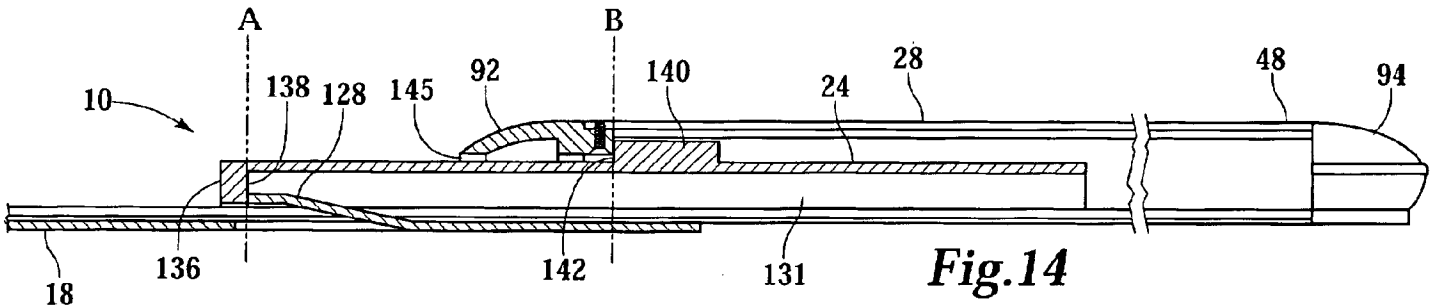
FIG. 14 is a cross-sectional view of the outer housing member and intermediate housing member engaged at a second extended stop position of the valet rack assembly.

An outer housing member 28 is slidably coupled to the intermediate housing member 24 and provides a second range of extension, as indicated by the arrow 30, for extension from a fully retracted position wherein the outer housing member overlaps substantially the entire intermediate housing member, to a fully extended position where the outer housing member 28 only partially overlaps the intermediate housing member 24, as shown in FIG. 1 and FIG. 14.

The base rail 18 is formed of sheet metal, preferably 22 gauge galvanized sheet steel, that has been cut, stamped and rolled. The intermediate housing member 24 is formed of an engineering plastic material such as ABS, polycarbonate, rigid polyvinylchloride, polypropylene, acetyl, cellulose acetate butyrate, polystyrene or other high impact resistance plastic polymer resin material, fabricated by pneumatic thermoform processes. The outer housing member 28 is highly visible and may be formed of a decorative material, preferably extruded aluminum having an anodized finish. Optionally, the outer housing member may be an engineering plastic material such as ABS plastic fabricated by pneumatic thermoform processes, and having a high gloss finish.

Apparel support members 32, 34 and 36 are slidably coupled to the outer housing member 28 to provide hanging support for apparel articles such as belts and neckties. For example, the support members 32 and 34 support neckties 38 and 40, respectively. As illustrated, the apparel support member 36 provides hanging support for a belt 42.

Figure 2:
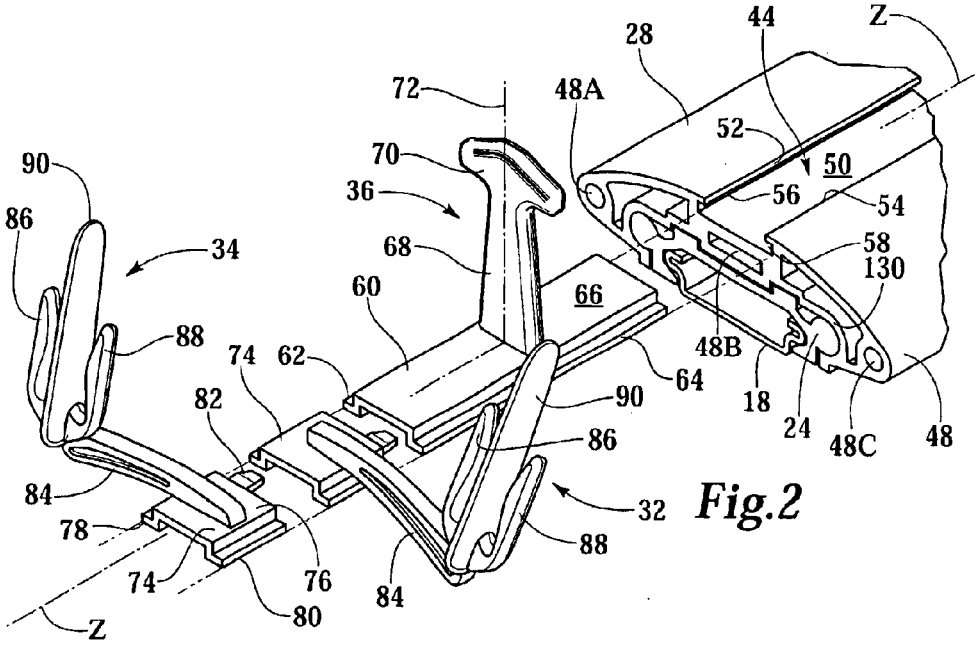
FIG. 2 is a perspective view of apparel support elements being inserted into the slide channel of the valet rack assembly.

Referring now to FIG. 2, the apparel support elements 32, 34 and 36 are shown being inserted during initial assembly into sliding engagement with the outer housing member 28. The outer housing member is intersected by an open slide channel 44 that extends longitudinally between opposite end portions 46, 48. The slide channel 44 is bounded by a slide face 50 disposed between parallel sidewalls 52 and 54. The slide channel 44 is enlarged by parallel grooves 56 and 58 formed in the opposite sidewalls, and extending along the length of the outer housing between the opposite end portions 46, 48.

The apparel support element 36, which is in the form of a universal belt post, includes an elongated longitudinal channel-shaped base member 60 having side flange portions 62, 64. The base member 60 is disposed for sliding surface engagement along the slide face 50 with the side flange portions slidably engaged in the groves 56, 58. A web portion 66 spans the channel and the parallel side flanges 62 and 64 engage in the side grooves to provide stable base support. A shank portion 68 is connected to the web portion and projects outwardly to provide support for a retainer 70 for engaging and retaining the buckle of a belt. The shank 68 and retainer 70 are symmetrical about a longitudinal axis 72. Either end of the belt post support element 36 may therefore be inserted into the slide channel 44 and may be employed in a right or left wall installation as well as in an upright or inverted installation of the valet rack assembly 10.

The support element 32, which is in the form of a necktie clasp assembly, includes an elongated, channel-shaped base member 74 that slidably engages in the slide channel 44 of the outer housing member. The tie clasp element also includes a web portion 76 and laterally extending, parallel side flanges 78, 80 connected thereto and slidably engaged in the parallel opposed grooves 56, 58 of the slide channel 44 to provide stable base support. The apparel support elements are further stabilized within the slide channel by inter-locking engagement of male and female coupling members. In the preferred embodiment, a male tang portion 82 projects longitudinally from the web 76 for insertion into interlocking engagement in a complementary female slot 77 formed in an adjacent apparel support element, or in an end cap of the valet rack assembly 10.

A flex arm 84, attached to the web portion 74, is canted at an angel $\alpha$ thereto, as shown in FIG. 4. Clasp elements 86, 88 and 90 are attached to the arm portion and arranged symmetrically. As illustrated, the clasp elements 86 and 88 are closely spaced to the intermediate clasp element 90 to permit an apparel article, such as a necktie, to be lightly gripped between clasp elements 86 and 90 or between clasp elements 88 and 90. The symmetrical arrangement of the clasp elements permits the necktie clasp assembly to be employed in both upright and inverted installations of the valet rack assembly 10.

The construction of the neck tie support element 34 is comparable to the construction of the neck tie support element 32. As shown in FIG. 2, FIG. 3 and FIG. 4, the support element 32, 34 of the adjacent necktie clasp assemblies are canted by an angle $\alpha$ with respect to the longitudinal axis Z of the rack assembly and thereby maximize the visibility of neckties as they are lightly gripped and retained in close proximity for convenient access and selection. In the preferred embodiment, the angle $\alpha$ is an acute angle in the range of from about 75° to about 85° (from about 15 to about 25° with respect to a plane orthogonal to the longitudinal axis Z).

It will be appreciated that although only two necktie clasp assemblies in combination with a universal belt post are illustrated, any number and any ordering of elements can be arranged according to personal preference. The valet rack assembly 10 of the present invention may include only tie clasps or only belt posts, or any combination of tie clasps and belt posts across the length of the slide channel 44, according to personal preference. In one configuration, the outer housing is 28 is fourteen inches in length and can accommodate as many as twenty-four tie clasps, or as many as six belt posts. In another configuration, the outer housing is twelve inches in length and can accommodate as many as twenty tie clasps, or as many as five belt posts.

Figures 7, 8, 9:
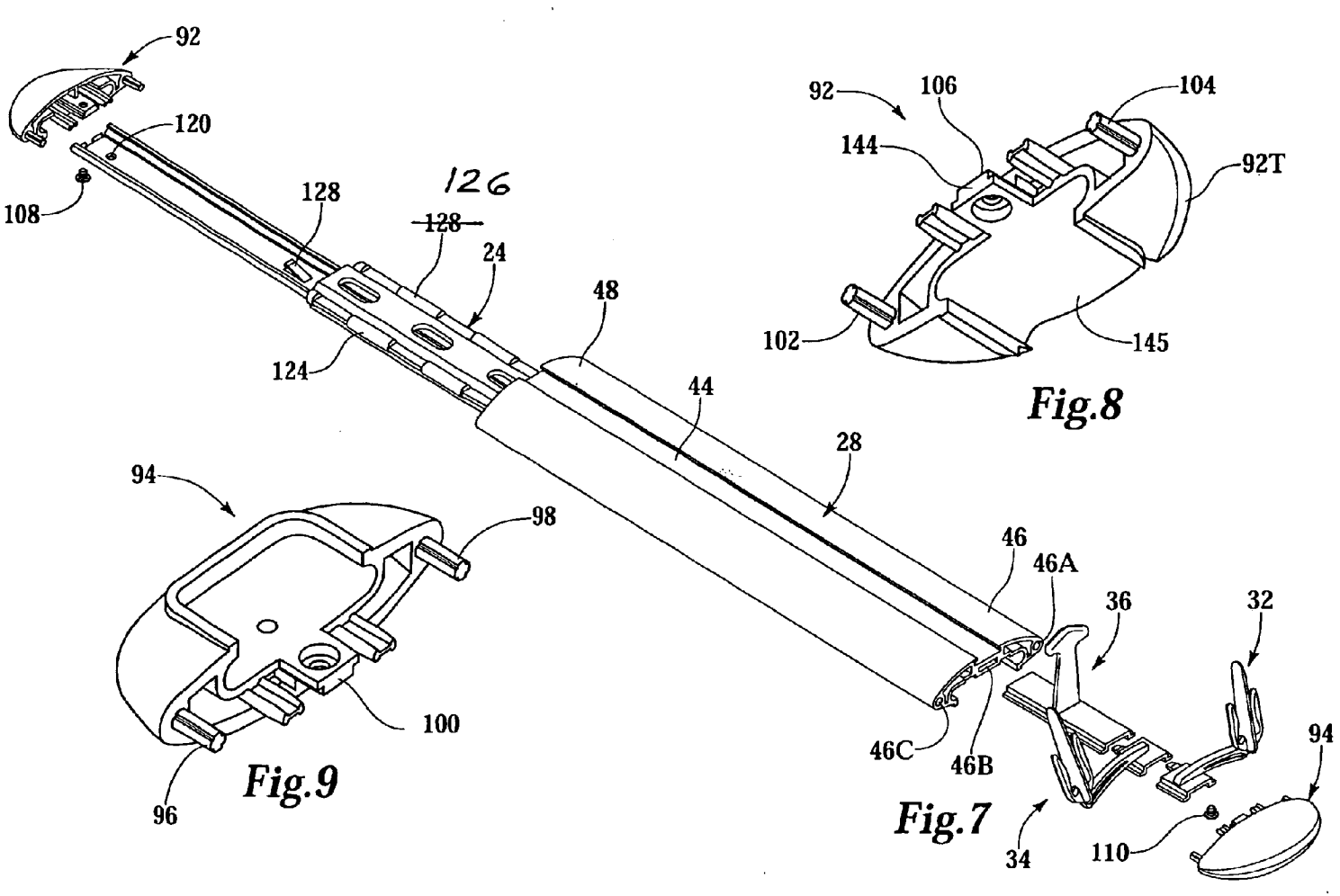
FIG. 7 is an exploded perspective view of the valet rack assembly.
FIG. 8 and FIG. 9 are perspective views of end caps that retain the slidable apparel support elements of the valet rack assembly.

FIG. 3 and FIG. 4 show the extendable/retractable rack assembly 10 of the present invention in the fully retracted position. The end portions 46, 48 of the outer housing member 28 are intersected by internal longitudinal pockets 46A, 46B, 46C and 48A, 48B, 48C, respectively, which open at the terminal faces of the end portions (FIG. 2 and FIG. 7). After the apparel supports are inserted into the slide channel 44, the slide channel is closed at each end by end caps 92 and 94. The end caps include longitudinally projecting fingers 96, 98, 100 and 102, 104, 106, respectively, that are "press-fit" insertable into the pockets for aligning the end caps with the outer housing member. After insertion, the end caps are secured to the opposite end portions of the outer housing member by machine screw fasteners 108, 110.

An apparel support element 36, which is illustrated as a universal belt post assembly, is interlocked with the end cap 94 to aid in retaining the apparel support members in the slide channel 44. In particular, the apparel support element 36 may be secured to the valet rack assembly 10 by first fastening the end cap 94 to the end portion 46 of the outer housing. The apparel support element may then be slidably inserted into the slide channel 44 as shown in FIG. 2 and moved along the channel until the base 60 engages the end cap.

Similarly, complementary apparel support members 32, 34, which are illustrated as tie clasp assemblies, are interlocked with each other and slidably engaged in the side grooves 56, 58 to provide retention when the valet rack assembly is in an upright or inverted orientation. For installation, the apparel support elements 32, 34 may be inserted into the longitudinal channel 44 at the open face of the end portion 46 and then moved along the channel until the tang portions 82 are engaged and the base 66 is brought into contact against end cap 94.

Figure 6:
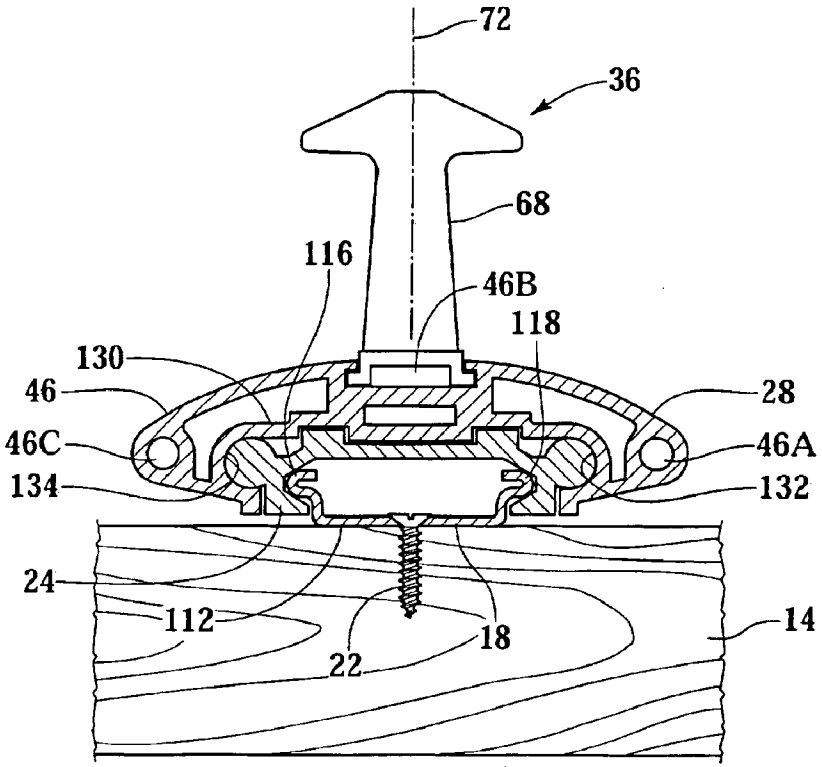
FIG. 6 is a cross-sectional view of the valet rack assembly taken along line 6—6 of FIG. 3.
Figure 5:
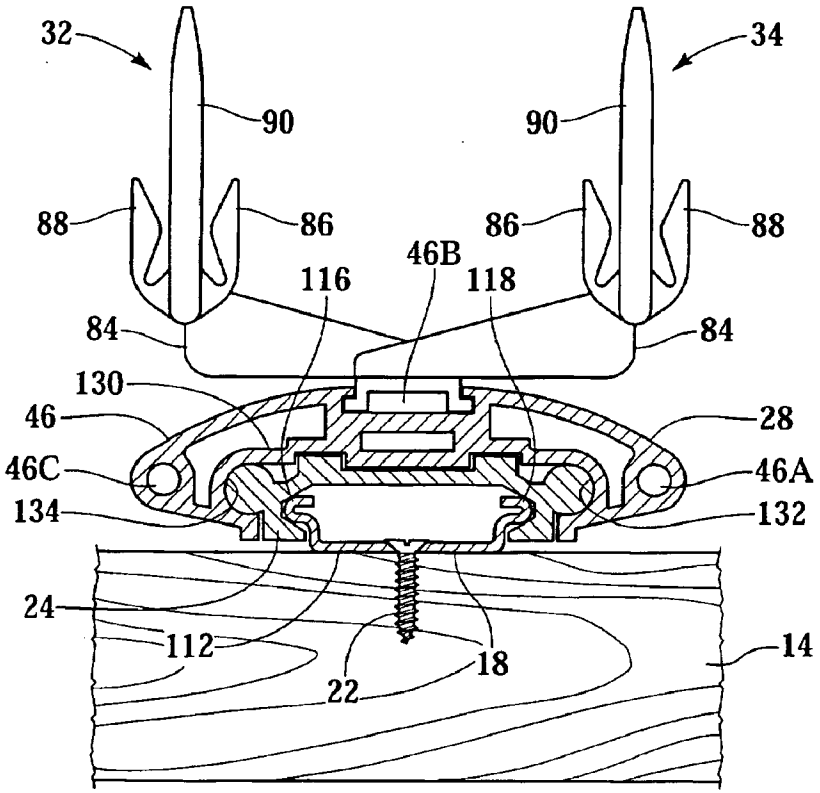
FIG. 5 is a cross-sectional view of the valet rack assembly taken along line 5—5 of FIG. 3.
Figure 10:
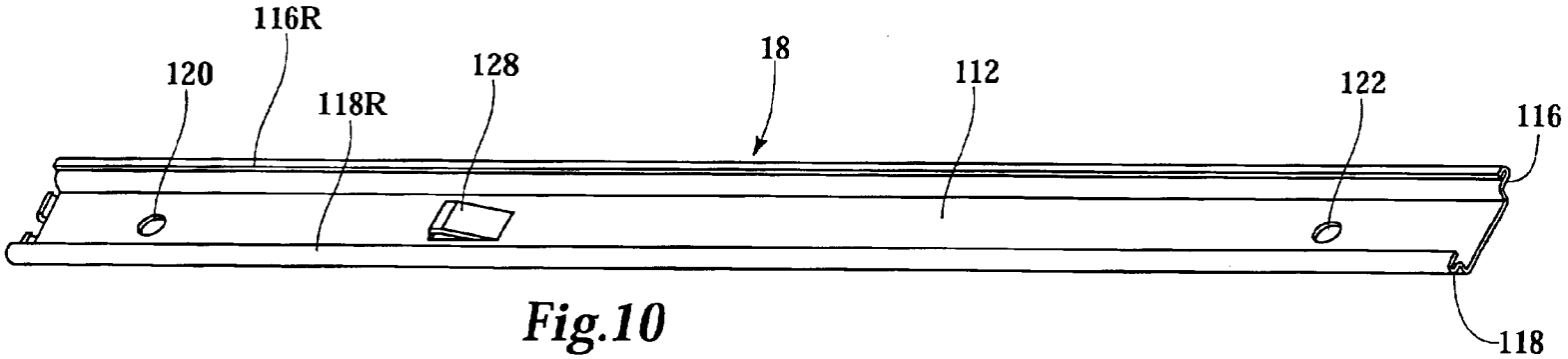
FIG. 10 is a perspective view of the base rail that is used to mount the valet rack assembly on a closet wall.
Figure 11:
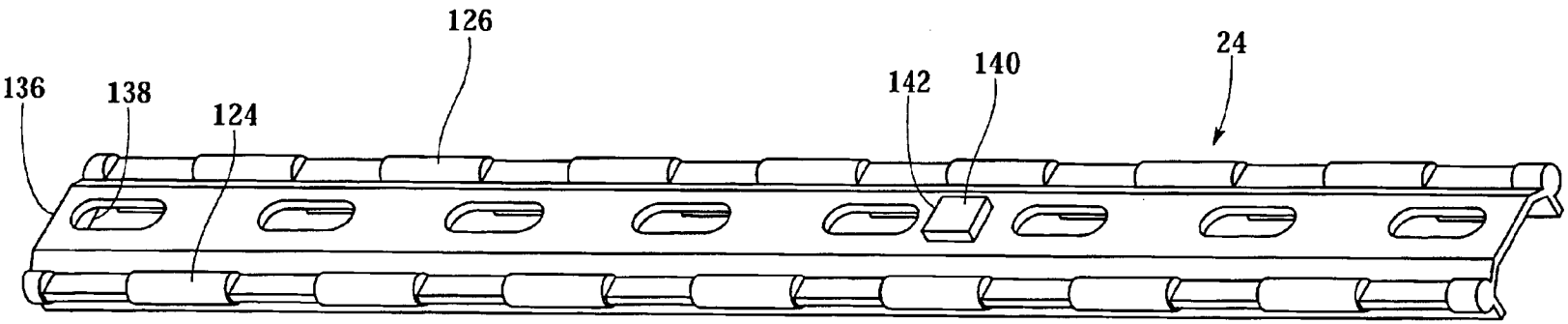
FIG. 11 is a perspective view of the intermediate housing member of the valet rack assembly.

Referring now to FIG. 5, FIG. 6 and FIG. 10, the base rail 18 of the valet rack assembly 10 has a base plate 112 and flanged sidewall portions 116 and 118. The base plate is drilled with openings 120, 122 for engaging the wood screw fasteners 20, 22 when the base rail is attached to a support structure such as the interior sidewall panel 14 of a closet. The flanged sidewall portions 116 and 118 have rolled edges 116R and 118R that engage and guide the intermediate extension member 24. Smooth barrel-shaped segments 124, 126 formed on the intermediate housing member 24 provide contact surfaces for engaging and guiding the outer housing member 28 along the intermediate housing member. A resilient spring finger 128 projects from the base plate for engaging a stop member that is carried by the intermediate housing member. The operation of the resilient spring finger 128 and member is described below.

Referring again to FIG. 2 and FIG. 7, the outer housing member 28 includes an elongated web portion 130 formed with complementary grooves for engaging the outer surface of the intermediate housing member 24. The longitudinal web portion 130 includes laterally opposite, parallel grooves 132 and 134 that provide sliding support and guidance for the barrel-shaped segments 124 of the intermediate housing member.

Figure 12:
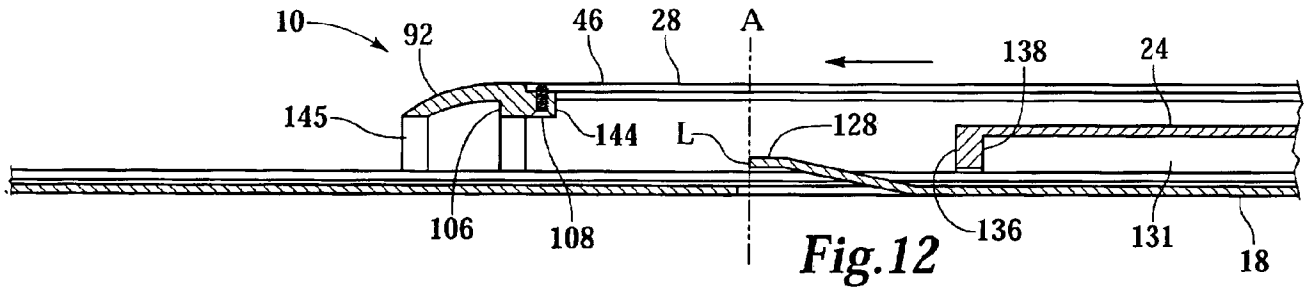
FIG. 12 is a cross-sectional view of the valet rack assembly in an initial assembly position prior to installation.

According to this arrangement, the intermediate housing member 24 is slidable in extension and retraction along the base rail 18 between the fully retracted position and a first stop position A as determined by the location of a first stop member 136 formed on one end of the intermediate housing member 24, as shown in FIG. 12, FIG. 13 and FIG. 14. Preferably, the stop member 136 is a shoulder formed as an integral part of the terminal end portion of the intermediate housing member 24, and has an internal face 138 for engaging the lip L of the resilient spring finger 128, as shown in FIG. 13.

During initial assembly as shown in FIG. 12, the intermediate housing member 24 is retracted along the base rail 18 and moves through an extension passage 131 between the base rail and the intermediate housing member, thus deflecting the spring finger 128 out of the extension passage as the stop member 136 moves across the sloping surface of the spring finger 128. After the stop member moves across the spring finger and clears the stop position A, the spring finger returns to its relaxed (unsprung) blocking position in the extension passage for subsequent engagement against the face 138 of the stop element 136 as the intermediate housing member is extended to the stop position A. Upon engagement, extension movement of the intermediate housing member is halted at the stop position A, thus preventing over-extension and maintaining structural rigidity of the extended rack assembly 10. Preferably, no more than about two-thirds of the base rail 18 is exposed (uncovered) when the intermediate housing member is moved into engagement against the spring finger at the stop position A.

A second stop element 140 is formed on the upper side of the intermediate housing member 24, as shown in FIG. 13 and FIG. 14. The second stop element 140 is a boss having a rectangular profile in cross-section, and has a stepped shoulder portion 142 for engaging the end cap 92, thereby establishing a second stop position B upon engagement. Referring to FIG. 7, FIG. 8, FIG. 13 and FIG. 14, the end cap 92 has an inboard shoulder 144 disposed for interfering contacting engagement against the second stop element 140 as the outer housing member 28 is extended relative to the intermediate housing member 24. Preferably, the shoulder 144 is formed on the inboard face of the coupling finger 106 of the end cap 92.

The end cap 92 is attached to the outer housing member by the screw fastener 108, which engages the outer housing in a threaded union. The terminal end 92T of the end cap is intersected by a large opening 145 through which the intermediate housing member 24 slides as the outer housing 28 extends and retracts.

Upon engagement as shown in FIG. 14, further extension of the outer housing member 28 is halted at the stop position B, thus preventing over-extension and maintaining structural rigidity of the extended rack assembly. Preferably, no more than about two-thirds of the intermediate housing member 24 is exposed (uncovered) when the stop shoulder 144 is moved into engagement against the shoulder portion 142 of the boss 140 at the stop position B.

Generally, full extension of the valet rack assembly 10 is 100 percent of its fully retracted length. For example, the valet rack assembly 10 can be extended from its fully retracted, minimum profile length of about fourteen inches to as much as twenty-eight inches when fully extended as shown in FIG. 1. Moreover, the overall extension length of the rack assembly can be continuously adjusted between those extremes according to personal preference.

Figure 15:
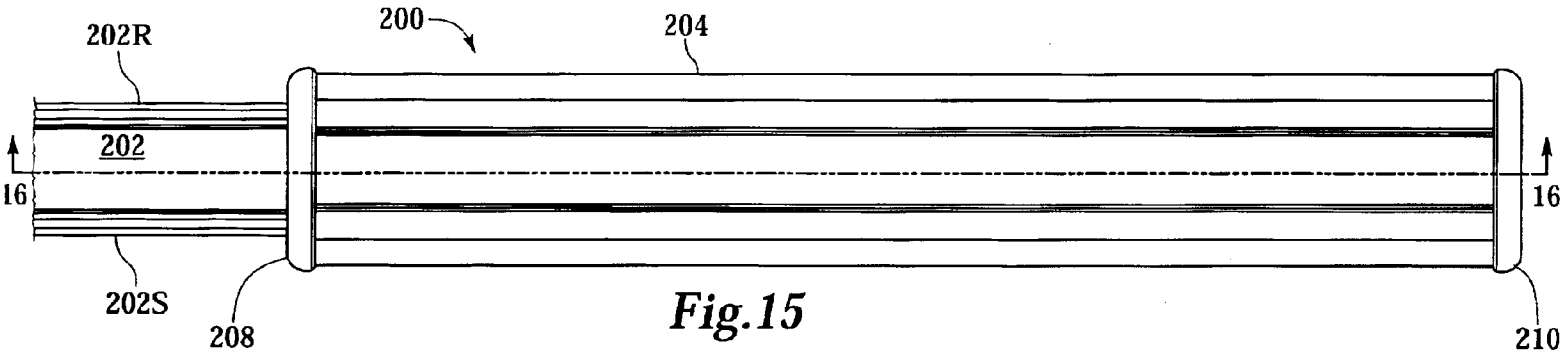
FIG. 15 is a top plan view of a high-strength valet rack embodiment of the present invention.
Figure 16:
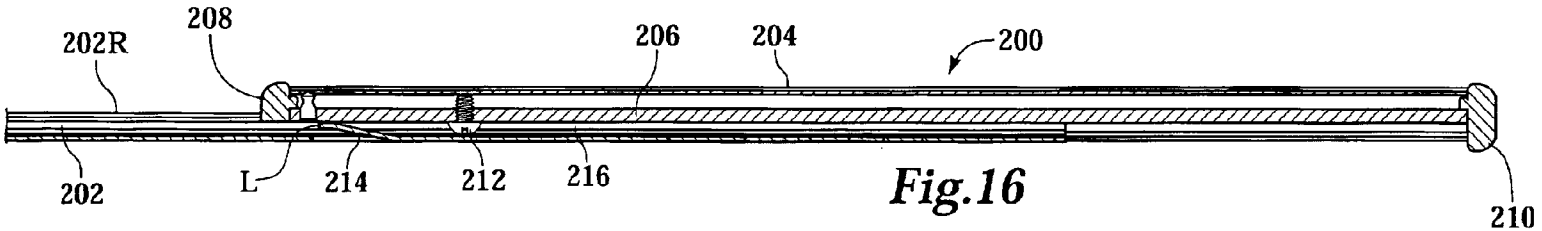
FIG. 16 is a cross-sectional view thereof, taken along the line 16—16 of FIG. 15.
Figure 17:
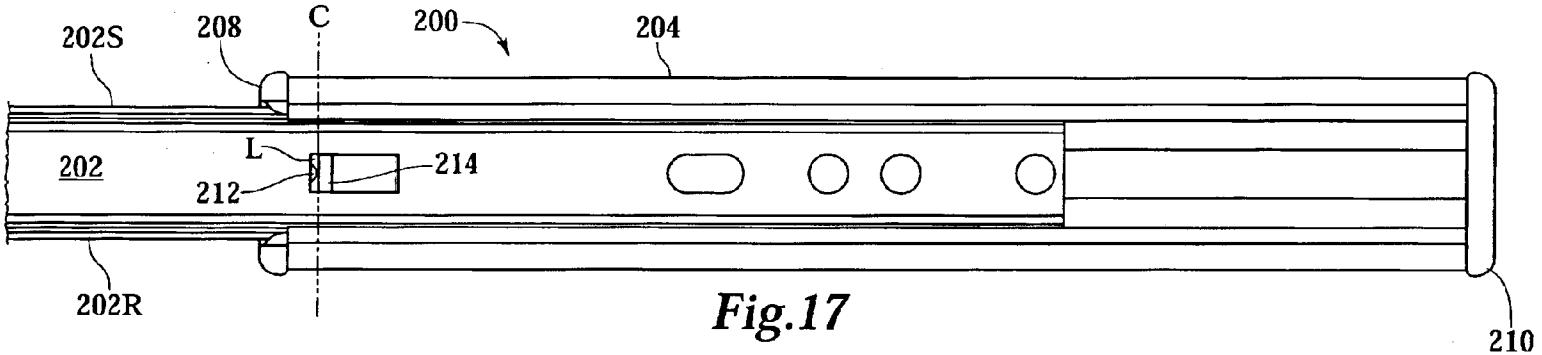
FIG. 17 is a bottom plan view thereof.

Referring now to FIG. 15, FIG. 16 and FIG. 17, a high strength embodiment 200 of the valet rack assembly is shown. The valet rack assembly 200 is a two-piece slide assembly of a base rail 202 and a heavy duty housing 204, providing hanging support for a heavy load, for example a fully packed travel bag suspended in a vertical orientation for easy access to packed clothing items. The base rail 202 is formed of 22 gauge galvanized sheet steel, with side flanges 202R, 202S having rolled edges similar in construction to the base rail 18, and is like-wise adapted for installation on the sidewall panel of a closet enclosure. The valet support assembly 200 can safely support a hanging load in the range of from about 50 pounds to about 75 pounds, for example, the typical hanging weight of a fully packed, large travel bag. The heavy duty housing 204 is preferably formed of extruded aluminum having a web thickness of from about 0.250 inch to about 0.375 inch.

The outer housing 204 includes an elongated, heavy-duty web portion 206 formed with complementary grooves for engaging the rolled edges of the base rail side flanges 202R, 202S. The housing web 206 is intersected by internal longitudinal pockets that open at the terminal faces on the opposite end portions of the housing. The opposite end portions are covered by end caps 208, 210 which include longitudinally projecting fingers that are "press-fit" insertable into the pockets for aligning the end caps with the outer housing 204. The end caps are secured to the housing end portions by machine screw fasteners (not shown).

According to this arrangement, the outer housing 204 is slidable in extension and retraction along the base rail 202 between the fully retracted position and a stop position C as determined by the point of engagement of a stop element 212 carried on the underside of the outer housing and a resilient spring finger 214 carried on the base rail 202, as shown in FIG. 16. The stop element 212 is a machine screw engaged in a threaded union with the housing web 206, and the head of the machine screw projects into the slide space 216 between the base rail and the web for engaging the resilient spring finger 214.

As the outer housing 204 is retracted along the base rail 202, the spring finger 214 is deflected out of the travel path as the head of the stop element 212 moves across the sloping surface of the resilient spring finger. After the stop member clears the spring finger, the spring finger returns to its relaxed (un-sprung), blocking position for interfering contacting engagement against the head of the stop member 212 as the outer housing 202 extends. Upon engagement, extension movement of the outer housing is halted at the stop position C, thus preventing over-extension and maintaining structural rigidity of the valet support assembly. Preferably, no more than about two-thirds of the base rail 202 is exposed (uncovered) when the outer housing 204 is moved into engagement against the lip L of the spring finger at the stop position C.

It will be appreciated that at a full range of extended positions are possible other than the stop positions illustrated herein. Accordingly, by providing an effective and aesthetically pleasing two-piece (heavy duty) and three-piece extendable slide arrangements, the valet rack assembly of the present invention provides a highly visible and systematic arrangement of apparel accessories such as neck ties and belts, as well as providing hanging support for clothing items that are supported on hangers, for example, shirts, coats, jackets, trousers, skirts and blouses, as well as supporting heavy travel bags for convenient access to packed clothing items.

Although the invention has been described with reference to certain exemplary arrangements, it is to be understood that the forms of the invention shown and described are to be treated as preferred embodiments. Various changes, substitutions and modifications can be realized without departing from the spirit and scope of the invention as defined by the appended claims.

We claim:

1. A valet rack assembly, comprising:

a base member including an elongated base plate adapted for surface mounting engagement onto a support structure, the base plate including an elongated side rail portion for supporting a hanging load;

an intermediate housing member slidably coupled to the side rail portion for extension and retraction movement along the base plate, the intermediate housing member being movable in a first range of extension movement from a retracted position wherein the intermediate housing member overlaps substantially all of the base plate, to an extended position wherein the intermediate housing member partially overlaps the base plate;

an outer housing member slidably coupled to the intermediate housing member, the outer housing member being movable in a second range of extension movement from a retracted position wherein the outer housing member overlaps substantially all of the intermediate housing member, to an extended position wherein the outer housing member partially overlaps the intermediate housing member; and an apparel support element disposed on the outer housing member, the apparel support element operable to provide hanging support for a clothing accessory.

2. A valet rack assembly, comprising:

a base member adapted for mounting on a support structure;

an intermediate housing member slidably coupled to the base member, the intermediate housing member being movable in a first range of extension movement from a retracted position wherein the intermediate housing member overlaps substantially all of the base member, to an extended position wherein the intermediate housing member partially overlaps the base member;

an outer housing member slidably coupled to the intermediate housing member, the outer housing member being movable in a second range of extension movement from a retracted position wherein the housing member overlaps substantially all of the intermediate housing member, to an extended position wherein the outer housing member partially overlaps the intermediate housing member;

an apparel support element disposed on the outer housing member, the apparel support element operable to provide hanging support for a clothing accessory; and wherein the apparel support element is slidably coupled to the outer housing member.

3. The valet rack assembly as set forth in claim 1, including a first stop member disposed on the base member and a second stop member disposed on the intermediate housing member, the first and second stop members being brought into interfering contacting engagement against each other when the intermediate housing member is extended to a first stop position, thus opposing further extension movement of the intermediate housing member relative to the base member.

4. The valet rack assembly as set forth in claim 3, wherein the intermediate housing member is spaced relative to the base member thereby defining an extension passage there between, and wherein:

the first stop member comprises a resilient spring finger that is deflectable relative to the base member from an unsprung position in which the spring finger is disposed in the extension passage for blocking engagement against the second stop member, to a deflected position in which the spring finger is retracted at least partially out of the extension passage, thereby permitting movement of the second stop member across the first stop position toward the retracted position.

5. The valet rack assembly as set forth in claim 3, wherein the intermediate housing member is spaced relative to the base member thereby defining an extension passage there between, and wherein the second stop element comprises a shoulder formed on the intermediate housing member, the shoulder projecting into the extension passage for interfering contacting engagement against the first stop member, thereby establishing the first stop position upon engagement.

6. The valet rack assembly as set forth in claim 1, including a third stop member disposed on the intermediate housing member and a fourth stop member disposed on the outer housing member, the third and fourth stop members being brought into interfering contacting engagement against each other when the outer housing member is extended to a second stop position, thus opposing further extension movement of the outer housing member relative to the intermediate housing member.

7. The valet rack assembly as set forth in claim 6, wherein the third stop member is a boss having a stepped shoulder portion for engaging the fourth stop element, thereby establishing the second stop position upon engagement.

8. The valet rack assembly as set forth in claim 6, wherein the outer housing member is spaced relative to the intermediate housing member thereby defining an extension passage there between, and wherein the fourth stop member comprises a shoulder formed on the outer housing member, the shoulder projecting into the extension passage for contacting engagement against the third stop member, thereby establishing the second stop position upon engagement.

9. The valet rack assembly as set forth in claim 1, further comprising:

a first stop member disposed on the base member and a second stop member disposed on the intermediate housing member, the first and second stop members being disposed in blocking engagement against each other when the intermediate housing member is moved to the first extended position, thus preventing further extension movement of the intermediate housing member relative to the base member; and a third stop member disposed on the intermediate housing member and a fourth stop member disposed on the outer housing member, the third and fourth stop members being disposed in blocking engagement against each other when the outer housing member is moved to the second extended position, thus preventing further extension movement of the outer housing member relative to the intermediate housing member.

10. The valet rack assembly as set forth in claim 1, wherein the outer housing member is intersected by a longitudinal slot, and the apparel support member is disposed for slidable extension and retraction movement along the slot.

11. The valet rack assembly as recited in claim 1, wherein the outer housing member is intersected by a longitudinal channel bounded by spaced sidewalls, and including a slide face disposed between the sidewalls, the sidewalls being intersected by first and second longitudinal grooves, respectively, and the apparel support member including first and second laterally projecting flange portions slidably engaged in the first and second grooves, respectively.

12. A valet rack assembly, comprising:

a base member adapted for mounting on a support structure;

an intermediate housing member slidably coupled to the base member, the intermediate housing member being movable in a first range of extension movement from a retracted position wherein the intermediate housing member overlaps substantially all of the base member, to an extended position wherein the intermediate housing member partially overlaps the base member;

an outer housing member slidably coupled to the intermediate housing member, the outer housing member being movable in a second range of extension movement from a retracted position wherein the housing member overlaps substantially all of the intermediate housing member, to an extended position wherein the outer housing member partially overlaps the intermediate housing member;

an apparel support element disposed on the outer housing member, the apparel support element operable to provide hanging support for a clothing accessory;

wherein the outer housing member is intersected by a longitudinal slot defined between opposite sidewalls and a slide face is disposed between the sidewalls, and the apparel support member is disposed for sliding movement on the slide face.

13. The valet rack assembly as set forth in claim 1, wherein the apparel support member comprises a clasp for engaging a necktie.

14. The valet rack assembly as set forth in claim 1, wherein the apparel support member comprises a post for engaging a belt buckle.

15. The valet rack assembly as set forth in claim 1, wherein the apparel support member comprises:

a base member;

a support arm projecting from the base member and canted at an angle relative thereto; and a plurality of clasp members attached to the support arm and spaced from each other, thereby defining at least one slot for receiving and gripping a clothing accessory.

16. The valet rack assembly as set forth in claim 1, wherein the apparel support member comprising:

a base member;

a post projecting from the base member for engaging a belt buckle.

17. A method for securing an apparel support member to a valet rack assembly having a first end and a second end, comprising the steps:

fastening a first end cap to the first end of the valet rack assembly;

slidably engaging an apparel support member into an elongated longitudinal channel at the second end of the valet rack assembly;

sliding the apparel support member along the longitudinal channel into an interlocking engagement with the first end cap, thereby securing the support member to the valet rack assembly; and fastening a second end cap to the second end of the valet rack assembly.

18. The method as set forth in claim 17, further comprising the steps of slidably engaging an additional apparel support member into the longitudinal slide channel at the second end of the valet rack assembly and sliding the additional apparel support member into an interlocking engagement with the apparel support member, thereby securing the additional apparel support member to the valet rack assembly.

19. A valet rack assembly comprising, in combination:

a housing member adapted for mounting on a support structure in an upright or inverted orientation; and an apparel support member coupled to the housing member, the apparel support member including:

a base member;

a support arm attached to and canted at an angle with respect to the housing member; and a flexing clasp attached to the support arm, the flexing clasp including first and second clasp members operable to grip and retain a clothing accessory in both the upright and the inverted orientations of the housing member.

20. The valet rack assembly as set forth in claim 19, further comprising:

a second apparel support member coupled to the housing member;

a support arm attached to and canted at an angle with respect to the housing member; and a second flexing clasp attached to the support arm, the second flexing clasp being operable to grip and retain a clothing accessory in both the upright and the inverted orientations of the housing member.

21. The valet rack assembly as set forth in claim 19, wherein the apparel support member comprises male and female coupling members disposed in interlocking engagement with each other.

22. A valet rack assembly comprising, in combination:

a base member operable to be mounted on a support structure in an upright or inverted orientation;

a housing member slidably coupled to the base member for extension and retraction relative thereto; and an apparel support member coupled to the housing member, the apparel support member including a support portion characterized by bilateral symmetry for retaining an apparel article in the upright and the inverted orientations of the housing member.

23. The valet rack assembly as set forth in claim 22, wherein the apparel support member is characterized by left and right symmetry for accommodating right wall and left wall installation of the housing member.

24. A valet rack assembly comprising, in combination:

a base member adapted for mounting on a support structure;

a housing member slidably coupled to the base member, the housing member being movable from a retracted position wherein the housing member overlaps substantially all of the base member, to an extended position wherein the housing member partially overlaps the base member;

a first stop member disposed on the base member and a second stop member disposed on the housing member, the first and second stop members being brought into interfering contacting engagement against each other when the housing member is extended to a stop position, thus opposing further extension movement of the housing member relative to the base member; and wherein the housing member is spaced relative to the base member thereby defining a travel passage there between, and wherein the first stop member includes:

a resilient spring finger that is deflectable relative to the base member from an unsprung position in which the spring finger is disposed in the travel passage for blocking engagement against the second stop member as the housing member moves toward the extended position, to a deflected position in which the spring finger is retracted at least partially out of the travel passage, thereby permitting movement of the second stop member across the first stop member as the housing member moves toward the retracted position.

25. The valet rack assembly as set forth in claim 24, wherein the housing member is spaced relative to the base member thereby defining a travel passage there between, and wherein the second stop member comprises a shoulder formed on the housing member, the shoulder projecting into the travel passage for interfering contacting engagement against the first stop member, thereby establishing the stop position upon engagement.

26. The valet rack assembly as set forth in claim 24, wherein the housing member is spaced relative to the base member thereby defining a travel passage there between, and wherein the second stop member comprises:

a machine screw engaged in a threaded union with the housing member, the machine screw having a head portion projecting into the travel passage for interfering contacting engagement against the first stop member as the housing member moves in extension to the stop position.

* * * * *